US005350108A

United States Patent [19]

Friar et al.

[11] Patent Number: 5,350,108

[45] Date of Patent: Sep. 27, 1994

[54] SELF-LOCKING BOX

[75] Inventors: C. Edward Friar, Macon; M. Lee Jones; H. English Robinson, Jr., both of Atlanta; Douglas N. King, Marietta, all of Ga.

[73] Assignee: Why Wrap? Incorporated, Atlanta, Ga.

[21] Appl. No.: 123,563

[22] Filed: Sep. 20, 1993

Related U.S. Application Data

[63] Continuation-in-part of Ser. No. 96,053, Jul. 22, 1993, abandoned, which is a continuation of Ser. No. 975,308, Nov. 11, 1992, abandoned, which is a continuation-in-part of Ser. No. 960,787, Oct. 14, 1992, abandoned.

[51] Int. Cl.[5] ..... B65D 5/10; B65D 5/42

[52] U.S. Cl. ..... 229/102; 229/148; 229/923

[58] Field of Search ..... 229/102, 148, 153, 923; 206/459.5, 807

[56] References Cited

U.S. PATENT DOCUMENTS

| | | |
|---|---|---|
| 636,806 | 11/1899 | Johnstone . |
| 916,503 | 3/1909 | Thompson . |
| 1,108,464 | 8/1914 | Morey . |
| 1,277,459 | 9/1918 | Myers . |
| 1,470,141 | 10/1923 | Bryson . |
| 1,530,644 | 3/1925 | Blandford . |
| 2,028,677 | 1/1936 | Lupton . |
| 2,044,701 | 6/1936 | Junkin . |
| 2,834,531 | 5/1958 | Struble . |
| 3,225,914 | 12/1965 | Klein . |
| 3,233,818 | 2/1966 | Bixler . |
| 3,451,535 | 6/1969 | Caplan . |
| 3,462,066 | 8/1969 | Farquhar . |
| 3,512,823 | 5/1970 | D'Esposito . |
| 3,690,542 | 9/1972 | Jernstrom . |
| 3,949,931 | 4/1976 | Hall . |
| 4,471,902 | 9/1984 | Skaggs . |
| 4,516,718 | 5/1985 | Forbes . |
| 4,752,028 | 6/1988 | Ogura . |
| 4,765,535 | 8/1988 | Michetti . |
| 4,830,270 | 5/1989 | Holmes . |
| 4,953,779 | 9/1990 | Densen . |

FOREIGN PATENT DOCUMENTS

| | | |
|---|---|---|
| 2846467 | 5/1980 | Fed. Rep. of Germany . |
| 039048 | 8/1978 | France . |
| 81 08698 | 4/1981 | France . |
| 2227731 | 8/1990 | United Kingdom . |

*Primary Examiner*—Gary E. Elkins
*Attorney, Agent, or Firm*—Jones & Askew

[57] ABSTRACT

A box for containing goods during storing, delivering, mailing, or shipping. The box has at least one end panel secured to a body panel by a locking tab and slot assembly so that the end panel cannot be unsecured without providing visible evidence of tampering. The leading edge of the locking tab has at least a partially tapered profile when the tab is folded for insertion through the slot. The slot may be curved to provide additional abutment between the associated locking tab and slot assembly. The container may have decorative motifs printed on the exterior surface to resemble a gift-wrapped box or a box having a unique or characteristic graphic design.

22 Claims, 7 Drawing Sheets

SELF-LOCKING BOX

CROSS-REFERENCE TO RELATED APPLICATION

This is a continuation-in-part of U.S. patent application Ser. No. 08/096,053 filed Jul. 22, 1993, ABN; which in turn is a continuation of U.S. patent application Ser. No. 07/975,308 filed Nov. 11, 1992 and now abandoned; which in turn is a continuation-in-part of U.S. patent application Ser. No. 07/960,787 filed Oct. 14, 1992.

BACKGROUND OF THE INVENTION

The present invention relates generally to boxes, and more specifically to boxes for storing, delivering, mailing, shipping, gift-giving, or otherwise containing various articles.

Boxes for containing goods have long been known in the prior art. In their simplest embodiment, those boxes comprise several body panels forming the sides of the box, and a pair of end panels connected to one or more of the side panels to close the ends of the box. The end panels usually are secured to the side panels by adhesive tape or the like, to close the box. The end panels may terminate with folded flap portions which are inserted in an adjacent relationship to one of the body panels to provide a self-securing closure, but such conventional closures usually are less secure than taping shut the box panels. The box may also feature a plurality of overlapping panels which are secured to each other by means of adhesive to form integral end panels. U.S. Pat. No. 3,512,823 is an example of such a box structure.

In order to provide a somewhat more secure closure mechanism, the end box panels have been provided with a tabbed portion along the distal edge thereof. These tabbed portions are simply inserted through a mating slot of substantially the same length located on a side panel of the box, the tab after insertion through the slot being glued to the exterior surface of the side panel. U.S. Pat. Nos. 916,503 to Thompson and 4,752,028 to Ogura disclose such a structure.

In the alternative, such tabs have been provided with leading edges which are longer in dimension than the length of the mating slot so that the tab and side panel around the perimeter of the mating slot provide interlocking abutment surfaces, as shown in U.S. Pat. Nos. 2,834,531 to Struble; 2,028,677 to Lupton; 1,530,644 to Blandford; and 4,516,718 to Forbes, Jr. The end portions of such an elongated tab must be folded upon the center portion thereof to permit inserting the tab through the slot, whereupon the elasticity or "memory" of the corrugated board causes the end portions to, revert towards their original portion, thereby providing the interlock. However, the leading edge of the locking tabs taught by these box configurations either protrudes through the slot so that it is exposed outside the box or else only provides marginal interlocking structure. Therefore, the locking tabs may be easily unlocked from engagement with the slot of the box and the top panel removed without leaving any visible evidence of tampering.

Some box manufacturers, therefore, have resorted to a locking tab arrangement whereby the tab is affixed to a box panel so that the tab is inserted into the box through the slot, whereupon the reverted locking tab is inaccessible. The only means of opening the box end panel, therefore, is to tear or sever the locking tab from where that tab joins the side panel of the box, thereby providing visible evidence of tampering. The profile of such panels may be rectangular (U.S. Pat. Nos. 4,830,270 to Holmes: 3,949,931 to Hall: 1,470,141 to Bryson; 1,108,464 to Morey; and 636,806 to Johnstone), crescent-shaped (U.S. Pat. No. 3,451,535), or slightly tapered, although still with a flat leading edge (U.S. Pat. No. 3,462,066 to Farquhar; and 4,471,902 to Skaggs). However, these tabs provide a completely straight leading edge when the end portions of the tab are folded onto the center portion thereof, thereby making insertion through the narrow slot difficult. Moreover, the double layered leading edge of the folded tab inevitably becomes slightly separated during the insertion stage, once again providing undesirable abutment between the tab and the slot prior to inserting the tab through the slot.

SUMMARY OF THE INVENTION

Accordingly, it is an object of the present invention to provide an improved self-locking box.

It is another object of this invention to provide a self-locking box structure which can be easily and quickly assembled for containing an article.

Still another object of the present invention is to provide a self-locking box structure having a folded tab construction which is readily inserted through a mating slot in the box while minimizing separation of the folded tab panels or abutment surfaces on the tab which can make insertion difficult and tedious.

Yet another object of the present invention is to provide such a box structure whereupon the assembled box cannot be opened without severing the tabs or another part of the box, thereby providing visible evidence of tampering.

Other objects of tile invention, in addition to those set forth above, will become apparent to those skilled in the art from the following disclosure.

Briefly, the invention is directed to a box, for packaging merchandise during mailing or shipment or for other purposes, and to a box blank for producing such a box. The box has at least one panel that is secured to another panel thereof by an associated locking tab and slot assembly so that the secured panel cannot be opened without providing visible evidence of tampering. The leading edge of the locking tab may have a partially tapered profile when the tab is folded for insertion through the slot.

Stated somewhat more specifically, a box according to the present invention has at least one end panel connected to a body panel for selectively closing a corresponding end of the box. That end panel has a flap extending into the box and there occupying a location adjacent to a body panel making up the box. The slot is located in the flap of the end panel, and the locking tab is connected to the body panel adjacent the location occupied by the flap.

Stated with greater detail, the locking tab on a box according to the present invention has a fold line defining a locking panel configured for insertion in the slot located in the end panel flap. The locking panel also has a fold line, defining a central portion and a terminal portion which is selectively foldable to lie alongside the central portion. When the terminal portion is folded in a certain manner to lie alongside the central portion, the locking panel becomes configured for insertion through the slot in the box. The slot may be straight or curved to provide additional abutment between the associated locking tab and slot assembly. The terminal portion thus becomes located between the slot and the end panel, whereupon the terminal portion partially unfolds to abut the end panel when the locking panel is fully pushed through the slot. The terminal portion of the locking panel thus engages the end panel, locking that end panel to the second body panel to form a closed box. The box as thus closed and locked cannot be opened except by cutting the locking tab or otherwise damaging the box, in such a way that an observer can immediately tell that someone has either opened or tampered with the box. Boxes according to the present invention may have decorative motifs printed on the exterior surface to resemble a gift-wrapped box or a box having a unique or characteristic graphic design.

Figure 1:
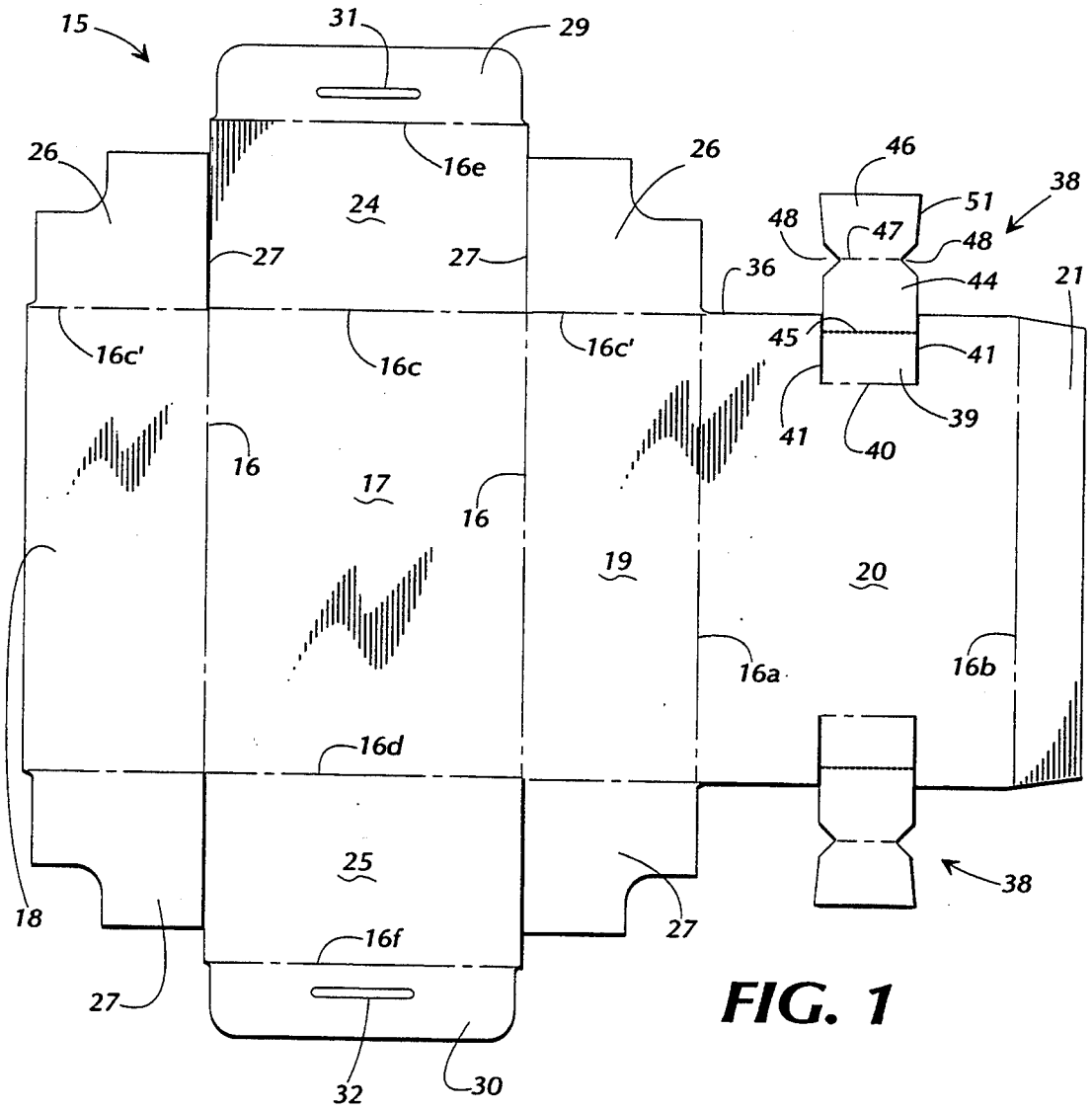
FIG. 1 is a plan view showing a box blank for producing a box according to a preferred first embodiment of the present invention.

FIGS. *3a–3c*, the latter of which is partially broken away for illustrative purposes, are fragmentary pictorial views showing a box assembled from the blank of FIG. 1, illustrating progressive stages of closing and locking an end panel of the box.

FIGS. *4a–4c* are fragmentary pictorial views of the box shown in FIGS. *3a–3c*, illustrating in progressive stages an alternative mode of closing the end panel without permanently engaging the locking tab.

Figure 5:
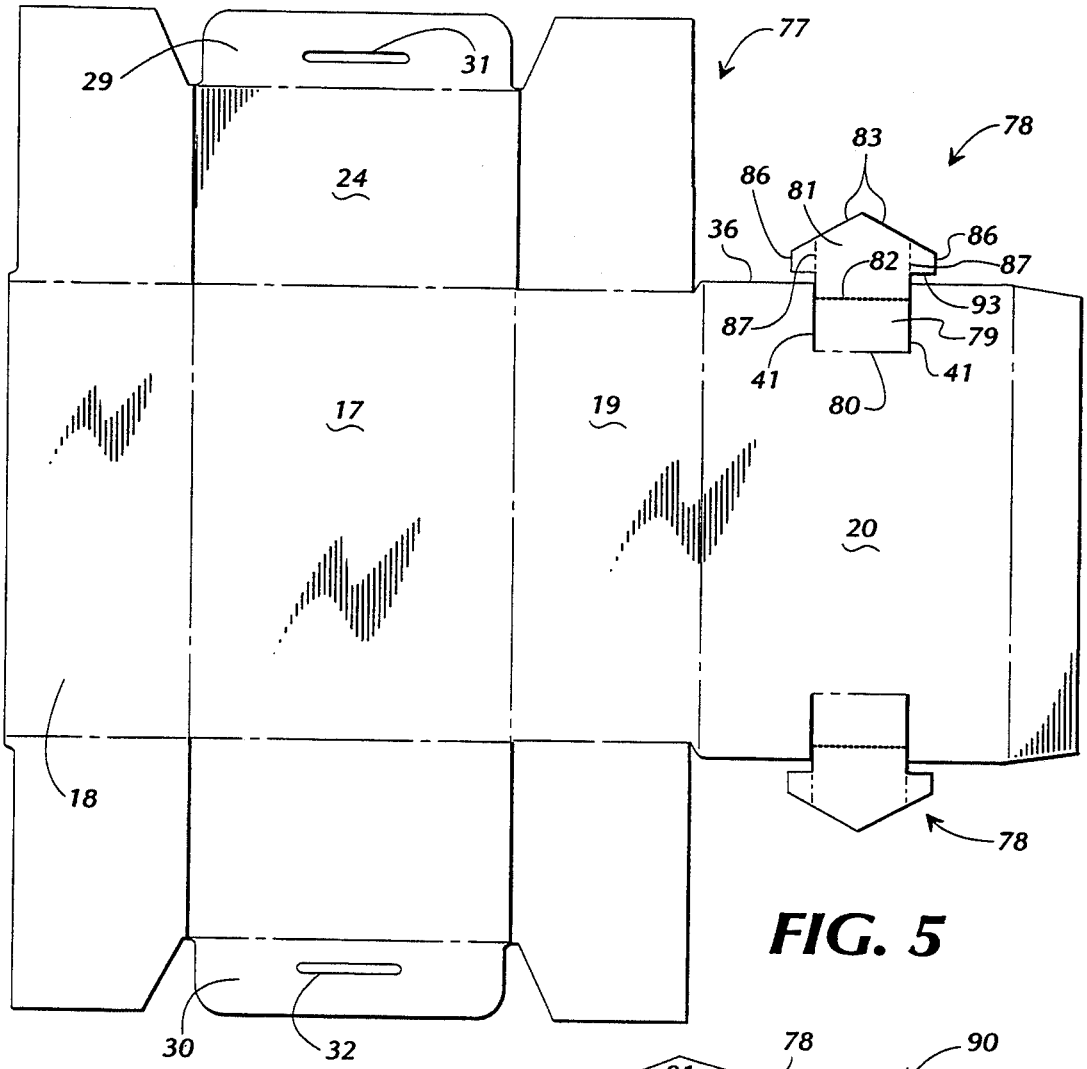

FIG. 5 is a plan view showing a box blank for producing a box according to a preferred second embodiment of the present invention.

FIGS. *6a* and *6b* are fragmentary pictorial views showing a box assembled from the blank of FIG. 5, in progressive stages of closure.

Figure 7:
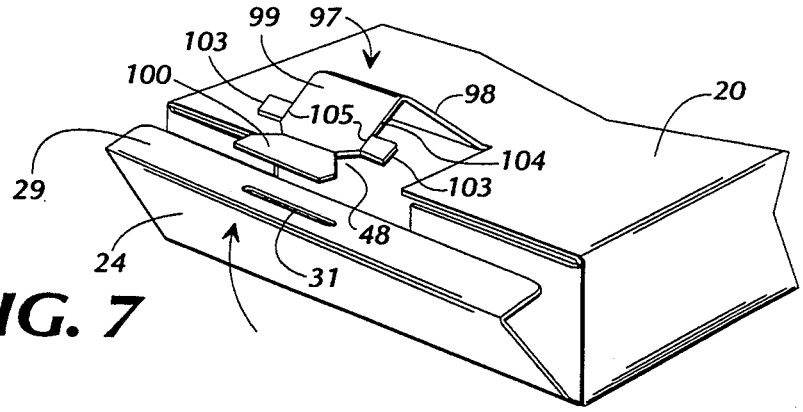

FIG. 7 is a fragmentary pictorial view showing a box according to a preferred third embodiment of the present invention.

FIGS. *7a* and *7b*, the latter of which is partially broken away for illustrative purposes, show the box of FIG. 7 in progressive stages of closure.

Figure 8:
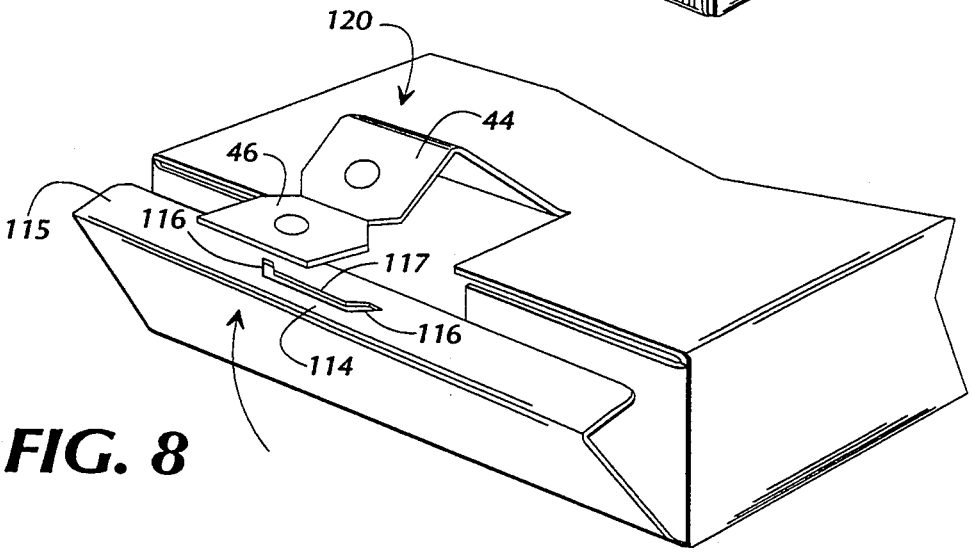

FIG. 8 is a fragmentary pictorial view illustrating a modification of the box slot in the flap of the end panel.

Figure 9:
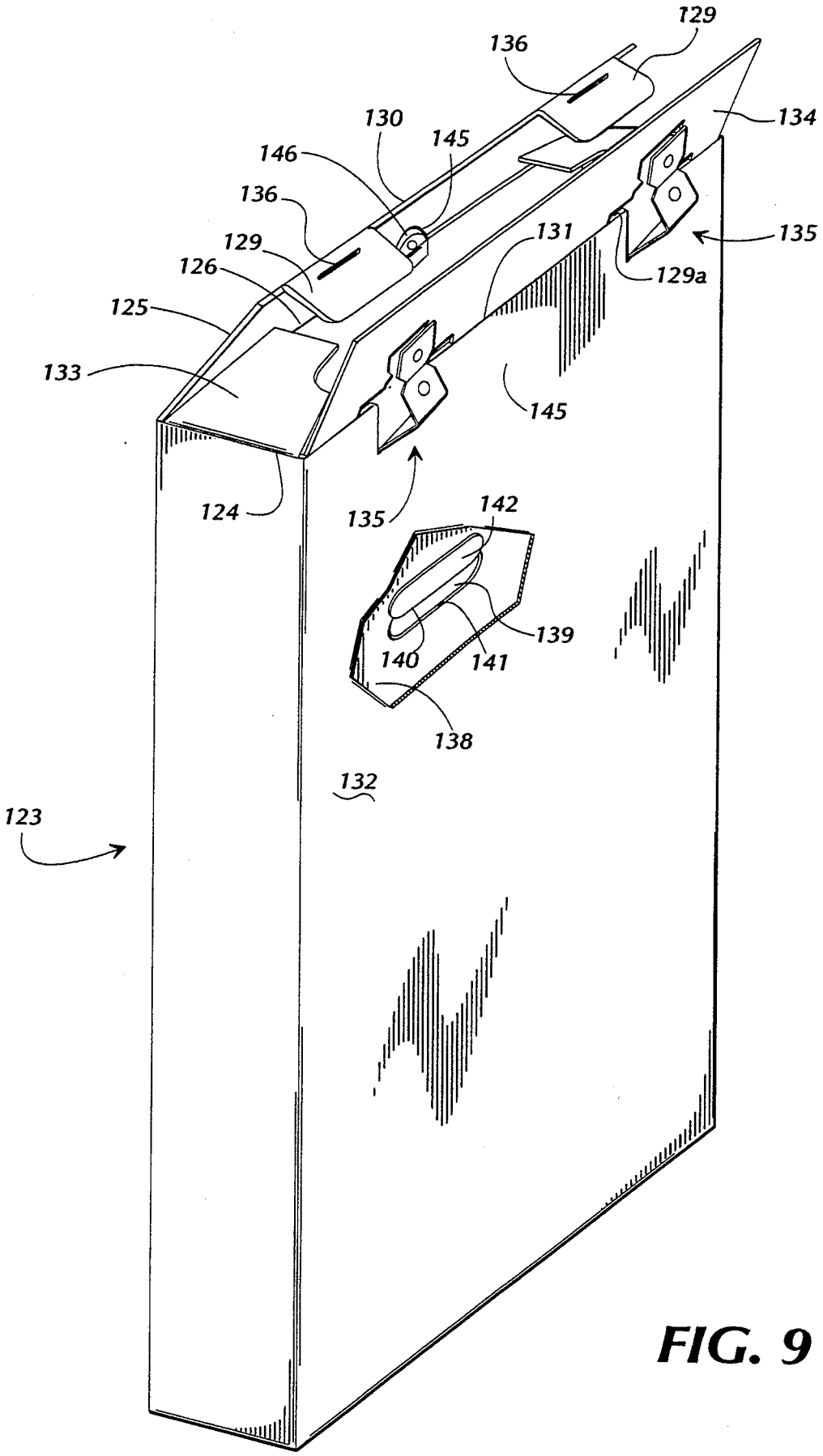

FIG. 9 is a pictorial view, partially broken away for illustrative purposes, showing a box according to a preferred fourth embodiment of the present invention, intended especially for containing an elongated article such as a garment bag.

Figure 10:
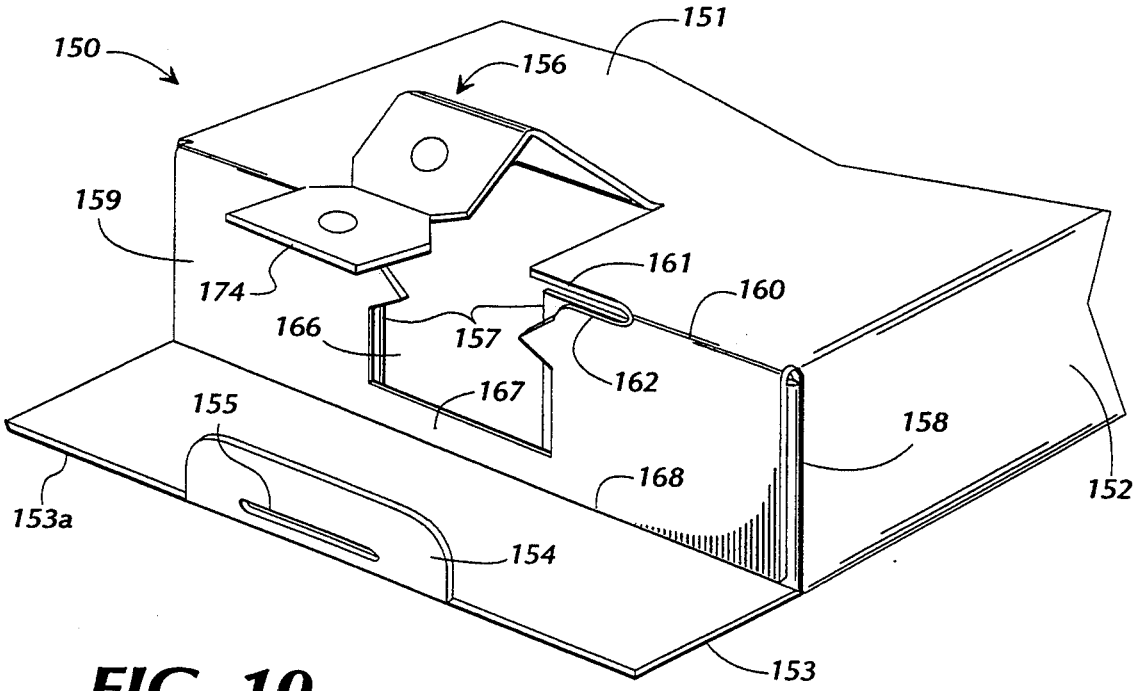
Figure 10A:
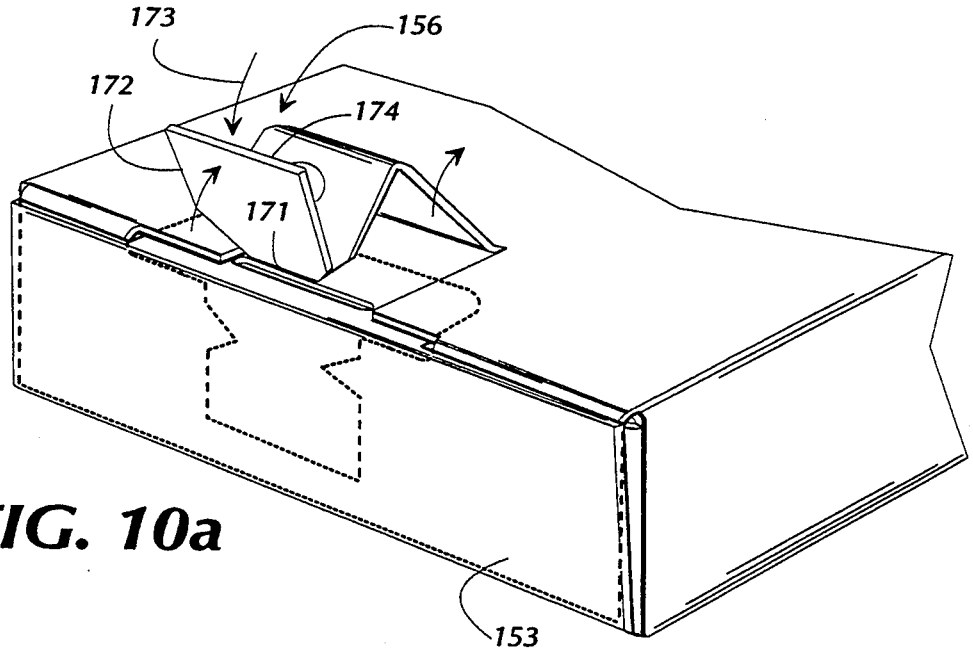

FIGS. 10 and 10*a* are fragmentary pictorial views showing a box according to a preferred fifth embodiment of the present invention.

DETAILED DESCRIPTION OF PREFERRED EMBODIMENTS

Turning first to FIG. 1, there is shown generally at 15 a box blank die-cut or otherwise formed from a suitable material such as corrugated board or the like. The box blank 15 includes a number of distinct panels defined by the several score lines 16 formed in the board while forming the blank, in a manner known to those skilled in the art. The distinct panels include the bottom panel 17 flanked by a pair of side panels 18 and 19, and a top panel 20 contiguous to the side panel 19 across the score line 16*a*. A glue flap 21 adjoins the opposite side of the body panel, across the score line 16*b*.

Adjoining the ends of the bottom panel 17 and separated therefrom by the score lines 16*c* and 16*d*, are the two end panels 24 and 25. A pair of corner flaps 26 flank the end panel 24, separated therefrom by the cut lines 27 perpendicular to the score line 16*c* and defining the sides of that end panel. Each corner flap 26 further is defined by the score lines 16*c*′, comprising an extension of the score line 16*c* and also defining first ends of the side panels 18 and 19. A second pair of corner flaps 27 likewise is defined flanking the end panel 25 at the opposite side of the box blank 15.

Separate flaps 29 and 30 are formed at the terminal ends of the end panels 24 and 25. The flaps 29 and 30 extend the length of the respective end panels 24 and 25. The score lines 16*e* and 16*f* along the end panels 24 and 25, parallel to the respective score lines 16*c* and 16*d* defining the end panels, define the respective flaps 29 and 30. Elongated slots 31 and 32 are formed in the respective flaps 29 and 30, paralleling the longitudinal dimension of those flaps.

The box 32 shown in FIG. *3a* is assembled from the box blank 15 by folding the box blank along the score lines 16, 16*a*, and 16*b* so that the bottom panel 17, side panels 18 and 19, and top panel 20 bear an orthogonal three-dimensional relation to each other as shown in that figure. The side panel 18 (not visible in FIG. *3a*) overlays and is adhesively attached to the glue flap 21 to maintain the assembled configuration of the box 32. The details of fabricating box blanks from corrugated board or other materials, and producing boxes from such blanks, are well known to those skilled in the art and need not be repeated herein.

Figure 2:
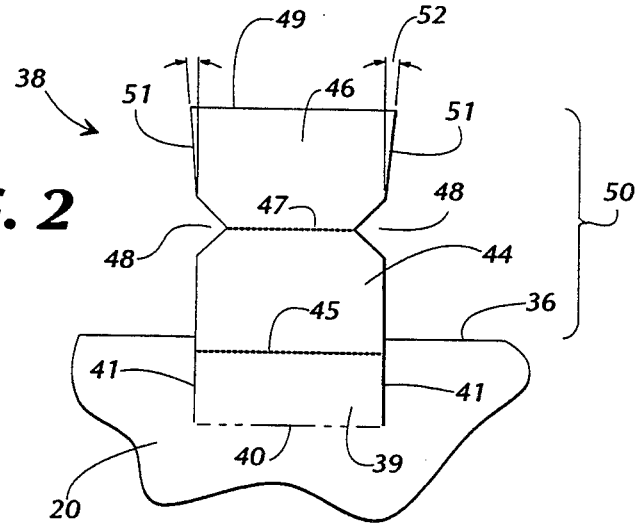
FIG. 2 is an enlarged fragmentary view of a locking tab in the box blank of FIG. 1, showing the taper of the front panel making up the locking tab.

With the box 32 thus assembled as shown in FIG. *3a*, it is seen that the end panel 24 is foldable along a line formed by the score line 16*c* to selectively close the open end 34 of the box. The end panel 25, not seen in FIGS. *3a–3c*, similarly is positioned to close the opposite end of the box 32. Such closure of either box end places the flap 29 of the end panel 24 through the gap 35 defined between the forward edge 36 of the top panel 20 and one side of each corner flap 26, those sides of the corner flaps being slightly undercut to help form the gap. This closure of the end panel 24 places the slot 31 of the flap 29 into alignment with the locking tab 38 formed at the confronting end of the top panel 20. This locking tab, as best seen in FIGS. 1 and 2, is one of two such tabs formed at opposite ends of the top panel 20 in the preferred embodiment of FIGS. 1–3, and only one such tab is described herein. However, it should be understood that a self-locking box can be produced with only one end equipped with self-locking structure according to the present invention. In that event, the other end of the box preferably would be permanently closed by some other means.

The locking tab 38, as best shown in FIG. 1, extends outwardly beyond the forward edge 36 of the top panel 20, at a right angle to that forward edge. The locking tab has three distinct segments, starting with a shank 39 defined by a score line 40 parallel to the forward edge 36 of the top panel 20 and set inwardly from that edge, and by the two parallel cut lines 41 (FIG. 1) perpendicular to the score line 40 and extending outwardly therefrom to the forward edge of the end panel. The score line 40 thus allows the entire locking tab 38 to bend relative to the top panel 20.

Joining the shank 39 of the locking tab 38 is the central panel 44. As best seen in FIG. 2, the central panel 44 is defined by the perforated line 45 parallel to the score line 40 and inset from the forward edge 36 of the top panel 20 by a distance less than the corresponding distance from the score line to the forward edge.

Referring again to FIG. 2, the central panel 44 extends outwardly from the line 45 and beyond the forward edge 36 of the top panel 20 to join the front panel 46 across the score line 47, parallel to the perforated line and the score line 40. The front panel 46 thus is foldable relative to the central panel 44. A V-shaped notch 48 is cut into each side of the central panel 44 and the front panel 46, the apex of each notch coinciding with corresponding ends of the score line 47 separating the front panel from the central panel.

The central panel 44 and front panel 46 together form a locking panel 50 of the locking tab 38, and the notches 48 help guide the locking panel into the slot 31 of the flap 29 in a manner to be described. As best seen in FIG. 2, the sides 51 of the front panel 46 are flared outwardly, indicated by the arc 52, instead of being perpendicular to the forward edge 36 of the top panel 20. This outward flare of the sides 51, together with the notches 48 formed between the central and front panels, help assist the locking panel 50 in entering the slot 31 of the flap 29, as described below.

The perforated line 45 shown in FIG. 1 is preferred, instead of a score line, to join the central panel 44 to the shank 39 because those two elements undergo bending at an acute angle during the locking procedure explained below. Moreover, perforated lines can be substituted for the score lines 40 and 47 that join the shank 39 to the top panel 20 and the front panel 46 to the central panel 44, respectively. By using perforated lines to define the elements of the locking tab 38, that locking tab becomes more easily cut or otherwise separated from the box when opening the box. The significance of such destructive opening is discussed below.

Figure 3A:
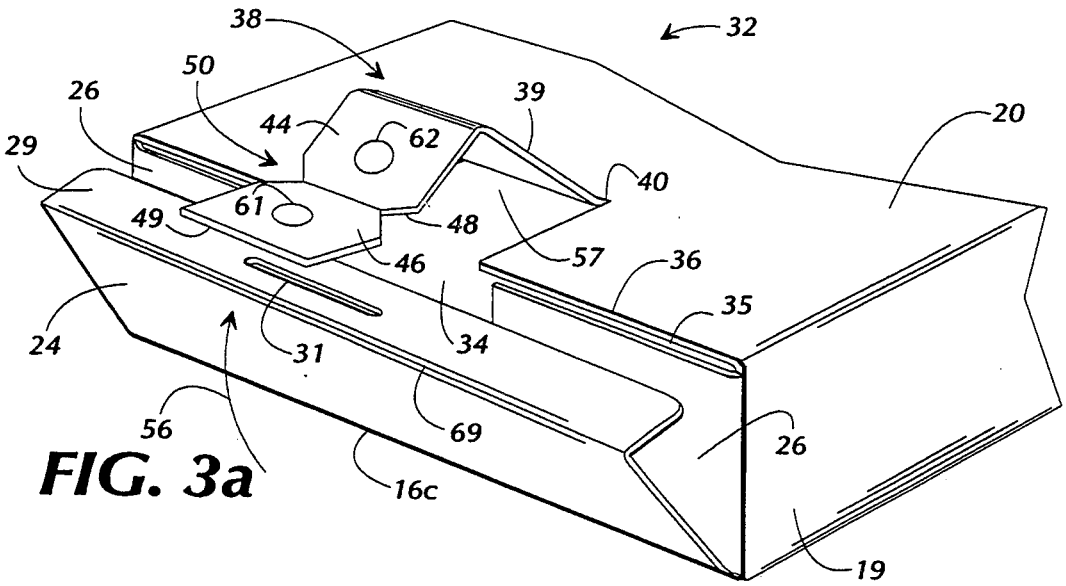
Figure 3B:
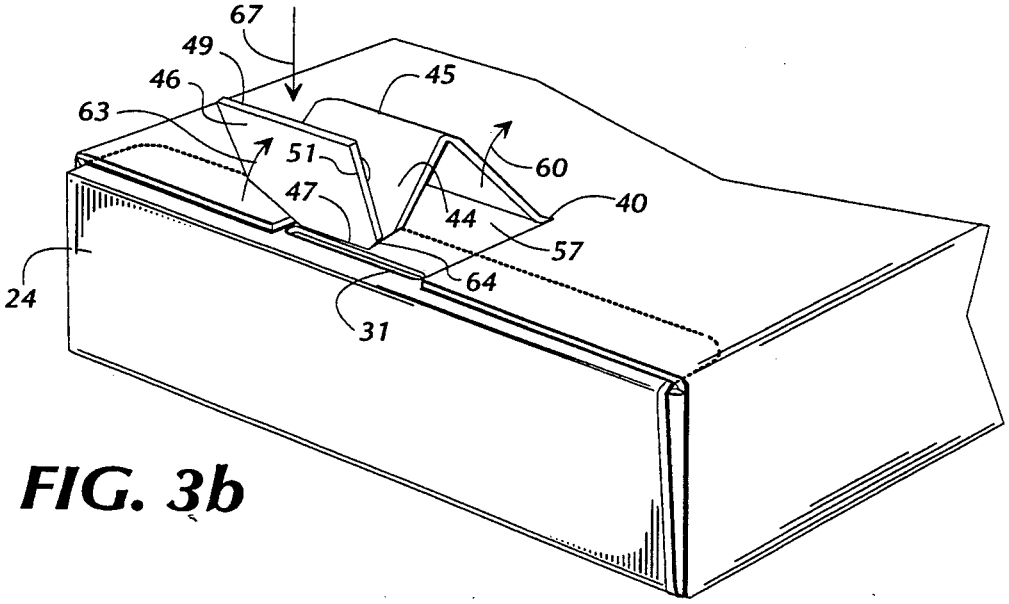

The operation of the box 32 will now be described with particular reference to FIGS. 3*a*, 3*b*, and 3*c*. Turning first to FIG. 3*a*, the end panel 24 is being folded along the score line 16*c* as shown by the arrow 56 to close the open end 34 of the box, so that the flap 29 of the end panel will enter the gap 35 immediately below the forward edge 36 of the top panel 20. That final position of the end panel 24 is shown in FIG. 3*b*. The locking tab 38 at this time is shown in FIG. 3*a* pivoted upwardly around the score line 40, exposing an open region 57 formerly occupied in the top panel 20 by the shank 39 and central panel 44 of the locking tab. That open region 57 exposes the slot 31 in the flap 29 of the end panel 24, in the final position of the end panel.

With the end panel 24 fully closed as shown in FIG. 3*b*, the locking tab 38 next is manipulated to the position shown in that figure by folding the shank 39 rearwardly along the score line 40, as represented by the arrow 60. At the same time, the central panel 44 is folded downwardly along the perforated line 45 to assume a nearly vertical attitude with respect to the top panel 20 and the flap 29. The front panel 46 at this time is folded back along the score line 47 adjoining the central panel 44, so that the outer surfaces of the locking panel 50 comprised by the front panel and central panel move toward each other as shown in FIG. 3*b*. The dots 61 and 62 (FIG. 3*a*) printed on the outer surfaces of the front panel 46 and central panel 44 are positioned to move into registry with each other as those panels are folded to the proper position of the locking panel 50. The desired folding movement of the front panel 46 at this time is shown by the arrow 63, FIG. 3*b*. The front panel 46 and central panel 44 thus are folded accordion-fashion into closely-abutting contact with each other, although for illustrative purposes those panels are shown with greater separation in FIG. 3*b*.

With the locking tab 38 thus folded as in FIG. 3*b* so that the shank 39 is angled upwardly from the top panel 20 and the central and front panels 44 and 46 folded accordion-fashion to contact each other, it will now be understood that the score line 47 of the locking panel 50 now is substantially aligned above the slot 31 in the flap 29 of the end panel 24. The notches 48 on both sides of the locking panel 50 now overlie each other to define the beveled corners 64 at each end of the folded score line 47. By exerting downward force as shown by arrow 67 on the top of the now-folded locking panel 50, the folded locking panel enters the slot 31 as the shank 39 of the locking tab 38 returns toward a position substantially flush with the top panel 20. The beveled sides 51 of the front panel 46 also assist in guiding the locking panel 50 downwardly through the slot 31.

The distance between the perforated line 45 and the score line 47 across the locking tab 38 is marginally greater than the corresponding distance between the score line 47 and the terminal end 49 of the front panel 46. This difference makes the front panel 46 marginally shorter than the central panel 44. As a result, the terminal end 49 of the front panel 46 becomes located a short distance below the perforated line 45 when the front panel is folded in the direction illustrated by FIG. 3*b* to lie alongside the central panel 44. Thus, the terminal end 49 of the front panel 46 becomes pushed completely through the slot 31 when the locking panel 50 is pushed to the fully-engaged position, shown in FIG. 3*c*, where the shank 39 is flush with the top panel 20 of the box. When the terminal end 49 of the front panel 46 thus clears the underside of the slot 31, the resiliency of the hinge provided by the perforated line 41 moves the front panel 46 forwardly in the direction of the arrow 68. The terminal end 49 of the front panel thus moves out of registry with the slot 31 and becomes lodged in the corner 69 of the end panel 24, where the flap 29 joins the end panel. This lodgement of the terminal end 49 thus captures the locking panel 50 within the box 32. It is now impossible to withdraw the locking panel 50 from the slot 31, or otherwise to disengage the locking tab 38 from the remainder of the box, without cutting some visible portion of the locking tab or otherwise mutilating part of the box such that tampering with the box becomes evident to the onlooker.

Figure 4A:
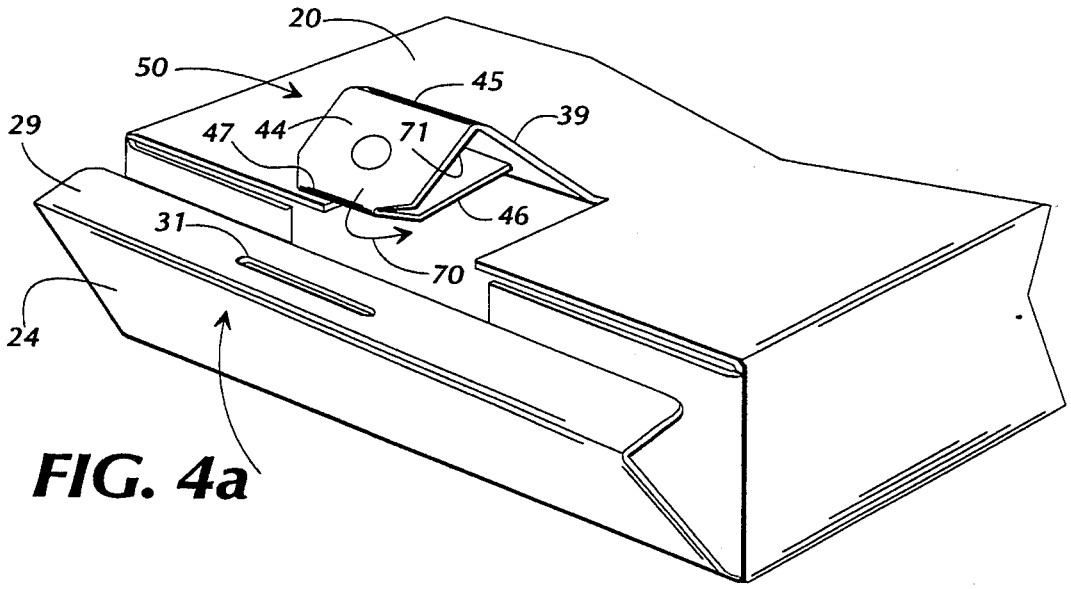
Figure 4B:
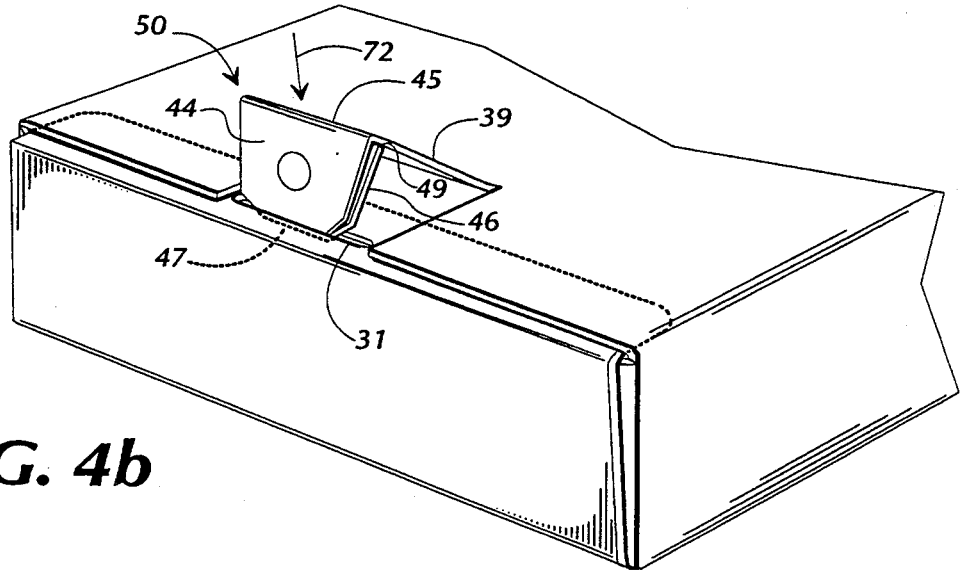
Figure 4C:
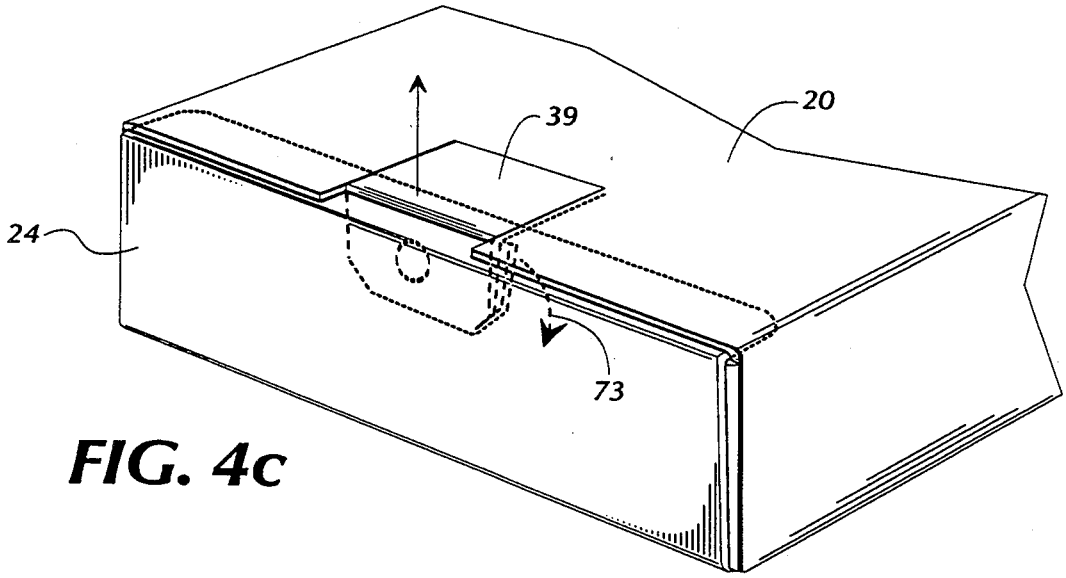

FIGS. 4*a*–4*c* show an alternative mode of using the box structure 32 shown and described above. In this alternative mode, the box can be closed but not permanently locked in that condition. Turning first to FIG. 4*a*, it is there shown that the front panel 46 first is folded along the score line 47 in the direction shown by the arrow 70 to lie beneath the central panel 44 of the locking panel 50. This movement of the front panel 46 is in the opposite direction from that shown by the arrow 63 in FIG. 3*b*. As a result, the front panel 46 becomes folded to lie flush with the inner surface 71 (FIG. 4*a*) of the central panel 44, a position shown in FIG. 4*b*. Because the front panel 46 is marginally shorter than the central panel 44 as previously mentioned, the terminal end 49 of the front panel fits snugly beneath the underside of the shank 39 in the inside corner formed by the perforated line 45.

With the locking panel 50 thus folded as shown in FIG. 4*b*, the edge formed by the fold on the score line 47 is aligned with the slot 31 in the flap 29. By pressing downwardly against the locking tab, as shown by the arrow 72, the locking panel 50 is pushed through the slot 31. Downward movement of the locking panel 50 continues until the shank 39 rests flush with the outer surface of the top panel 20, as seen in FIG. 4*c*. At that position of the locking panel 50, the terminal end 49 of the front panel 46 once again moves below the slot 31 within the box, and the natural resiliency at the hinge formed by the score line 47 causes the front panel 46 to swing outwardly from its former position immediately alongside the central panel 44, an action indicated by the arrow 73 in FIG. 4*c*. However, because the front panel 46 now is located on the side of the central panel 44 opposite from the end panel 24, the terminal end 49 of the front panel does not engage any box structure as the front panel reverts to a position determined by the resiliency of the hinge formed by the score line 47. The locking panel 50 thus is not captured in place within the box, in the final position shown in FIG. 4*c*, so that it remains possible to withdraw the locking panel from the slot by engaging the sides or free end of the shank 39 with fingernails or a knife-like object and working the now-unfolded locking panel upward through the slot 31.

Figure 6A:
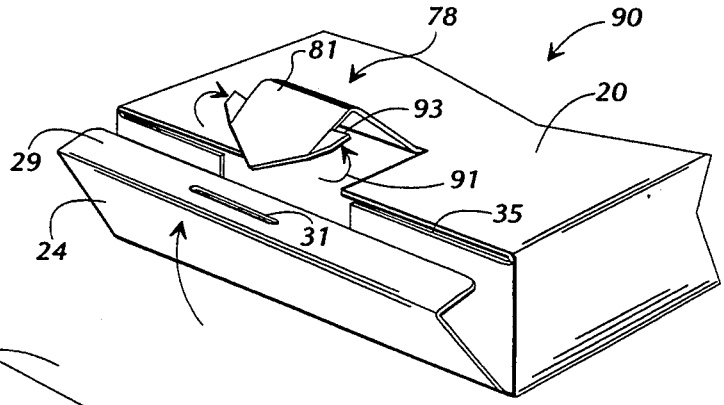
Figure 6B:
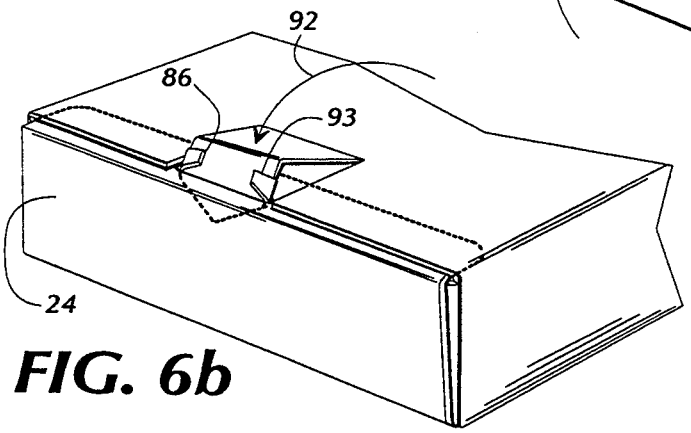

An alternative embodiment of the present invention is shown in the box blank 77 of FIG. 5, and in the box assembled from that blank as shown in FIGS. 6*a* and 6*b*. Except for the locking; tabs 78, the box blank 77 is similar in layout to the box blank 15 discussed above and the same reference numerals are used to denote many elements of each box blank. However, each lockings, tab 78 contains only two panels instead of the three panels formed in the locking tab 38. Those two panels of the locking tab 78 are the shank 79 formed in the top panel 20 by the score line 80 parallel to the forward edge 36 of the top panel and spaced inwardly from that forward edge, and by the two cut lines 41 perpendicular to that score line. Attached to the shank 79 by a second score line 82, spaced inwardly from the forward edge 36 by a lesser amount than the score line 80, is the front panel 81. The two beveled edges 83 define the terminal end of the front panel 81 in the shape of an arrowhead. The two wing tabs 86, one at each side of the front panel 81, are formed by the corresponding score lines 87 perpendicular to the score lines 41 defining the locking tab 78 in the top panel 20.

Turning next to FIGS. 6*a* and 6*b*, there is fragmentarily shown at 90 a box assembled from the box blank 77. Once the end panel 24 is closed by inserting the flap 29 through the gap 35 formed as previously described, the locking tab 78 is positioned so that the arrowhead formed by the beveled edges 83 is above and pointed downwardly toward the slot 31 in the flap 29. The wing tabs 86 next are folded back along the score lines 87 so as to lie alongside the outer surface of the front panel 81, as represented by the arrows 91 in FIG. 6*a*. With the wing tabs 86 thus folded, the locking tab 78 next is pressed downwardly as shown by the arrow 92, FIG. 6*b*, moving the arrowhead into and through the slot 31. Once the wing tabs 86 pass through the slot 31, the natural resiliency of the box material reverts those wing tabs back at least some extent from their previously folded position, and that reversion places the end surface 93 of each wing tab beneath the flap 29 of the end panel 24 within the box 90. The partly-unfolded wing tabs 86 thus retain the front panel 81 of the locking tab in position within the box, thereby preventing reopening of the end panel 24 without cutting or otherwise damaging the locking tab 78 or some other portion of the box.

Figure 7A:
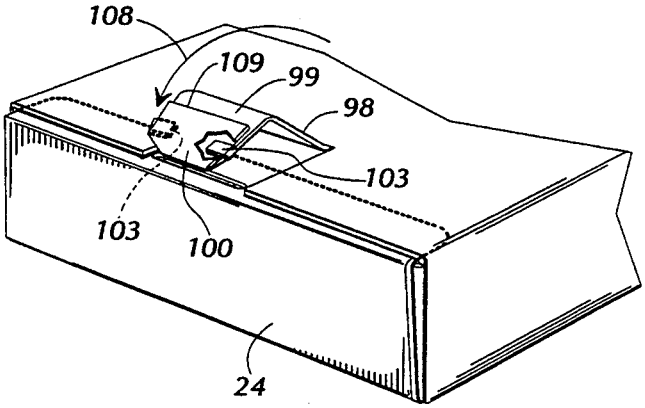
Figure 7B:
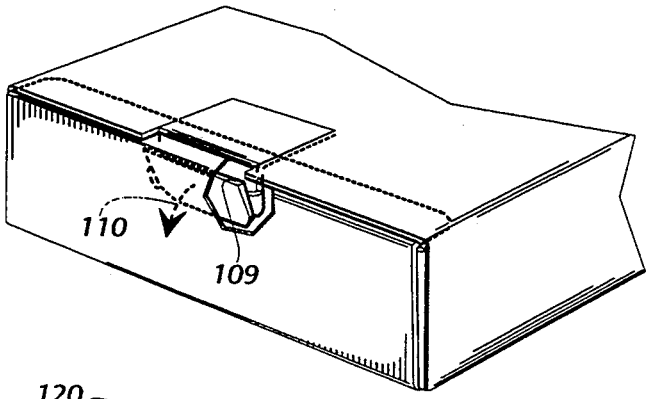

A third embodiment of the present invention is shown in FIGS. 7, 7*a*, and 7*b*, where the locking tab 97 is formed in the top panel 20 of a box in a manner similar to the locking tab 38 shown in FIG. 3*a*. The locking tab 97 includes a shank 98 at one end joined to the top panel 20 by a score line, and joined at the other end to the central panel 99. A front panel 100, in turn, joins the other end of the central panel 99 across another score line. The front panel 100, central panel 99, and shank 98 thus form a locking panel capable of being folded back accordion-style, as previously explained with regard to the locking panel 50 in FIGS. 3*a*–3*c*.

The locking tab 97 differs from the locking tab 38 by having a pair of side panels 103 laterally extending from each side 104 of the central panel 99. These side panels 103 are located adjacent the V-shaped notches 48 formed in the sides of the central panel 99 and front panel 100, where those panels mutually connect across the score line separating those two panels. Each side panel 103 is joined to the central panel 99 by a score line 105 forming an extension of the corresponding side 104 of the central panel.

The operation of the third embodiment is now described with regard to FIGS. 7*a* and 7*b*. Turning first to FIG. 7*a*, it is there seen that each of the side panels 103 has been folded forwardly around its defining score line 105 to overlay the top surface of the central panel 99. With the side panels 103 so folded, the front panel 100 next is folded up so that its top surface also overlies the top surface of the central panel 99, with the previously-folded side panels 103 now sandwiched between the central panel and front panel. With the locking tab 97 thus folded, the locking tab next is moved downwardly as shown by the arrow 108 in FIG. 7*a*, causing the locking panel formed by the central panel 99 and front panel 100 to enter the slot 31 in the flap of the end panel 24.

The length of the front panel 100 is somewhat less than that of the central panel 99, a condition best illustrated in FIG. 7*a* and previously explained herein. Once the locking panel is fully inserted through the slot 31, the terminal end 109 of the front panel is free to move forward toward the end panel 24, this movement illustrated by the arrow 110 in FIG. 7*b*. This forward movement of the front panel 100 is assisted by the tendency of the side panels 103, previously sandwiched between the front panel and the central panel 99, to unfold on the elastic hinge defined by the score lines 105. As a result, the terminal end 109 of the front panel 100 becomes securely lodged in the inside corner formed by the end panel 24 and the flap 29 now inserted into the box. The side panels 103 thus provide further security to the self-locking box shown in FIGS. 7, 7*a*, and 7*b*.

FIG. 8 shows a modification to further enhance the tamper-evident nature of the locking tab and slot in the present invention. The slot 114 is formed in the flap 115 with end portions 116 that are turned with respect to the center portion 117 thereof. The resulting slot 114 thus has a bent or curved configuration somewhat resembling a smile. The lateral edges of the central panel 44 and front panel 46 of the locking tab 120 must be bent or curved a corresponding amount in order to insert the locking tab through the curved slot 114. However, once the front panel 46 of the inserted locking tab clears the underside of the slot 114, the lateral edges of the front panel can revert to their original positions as the front panel resiliently moves forwardly to engage the underside of the flap 115. This reversion of the front panel 46 to its original flat shape makes it even more difficult to withdraw the locking tab from the slot without severing the tab or otherwise providing visible evidence of tampering.

The end portions 116 of the slot 114 should not be bent too severely relative to the center portion 117, or else it will become unduly difficult to insert the locking tab through the slot. In a preferred embodiment of the modification shown in FIG. 8, the center portion 117 of the slot 114 accounts for approximately 70%–75% of the total length of the slot. The angle between the center portion 117 and each end portion 116 preferably should be between 40° and 65°, although greater or lesser angles are possible within the scope of the invention. In this manner, the degree of angle is gentle enough to permit bending the locking tab 120 for insertion through the slot, while providing the extra degree of abutted interlock between the front panel 46 and abutted portions of the flap 115 surrounding the slot.

Although the embodiments described thus far are shown on boxes of general utility, self-locking boxes according to the present invention also are adaptable to various specification applications. One example of such a specific application is shown in FIG. 9, where is shown a box 123 specially configured for carrying elongated and relatively thin articles such as garment bags or the like. Boxes of the overall size and configuration of the box 123 are used in the airline industry for shipping garment bags as checked baggage without exposing the bags themselves to possible damage by baggage-handling machinery. The box 123 thus is wide enough to accommodate the width of a conventional garment bag, and is long enough to accommodate at least a major part of the length of a bag when inserted through the open upper end 124 of the box. The box 123 has an upper end panel 125 that selectively closes the upper end 124 and this upper end panel is attached to the back panel of the box by a fold line 126. The upper end panel 125 has a pair of flaps 129 bendable downwardly along the outer edge 130 of the upper end panel to enter the top of the box in juxtaposition with the upper edge 131 of the front panel 132. The lower end of the box 123 also can be fitted according to the present invention, if desired.

The box 123 has a pair of corner flaps 133 extending inwardly from the side panels of the box. When closing the box 123, these corner flaps 133 are folded over the open upper end of the box and a secondary end panel 134, joined to the upper end of the front panel 132 by the fold line at the upper edge 131, is folded over to cover the corner flaps. The upper end panel 125 then is folded over the secondary end panel and the flaps 129 are inserted into the slots **129*a* defined in the secondary end panel along the fold line at the upper edge 131**.

To provide an extra measure of locking security and strength for the upper end panel 125 of the relatively wide box 123, that box utilizes a pair of locking tabs 135 spaced equidistant from the sides of the front panel 132. These locking tabs 135 in the disclosed embodiment are of the same construction and design as the locking tab 38 described above, and each locking tab 135 engages a separate slot 136 formed in the flap 129 of the upper end panel 125. The two separate locking tabs 135 thus permit two-point locking of the end panel 125 when closed, providing greater security for the box 123 as that box undergoes the stresses of baggage handling.

A handle cutout 139 is formed in the back panel 138 to permit easy carrying of the box 123. The handle cutout 139 is oblong and is centrally located across the width of the front panel 132. The handle cutout 139 is defined by a horizontal score line 140 in the back panel 138 and by a parallel horizontal cut line 141 located below the score line and curving upwardly at its ends to join the ends of the score line, forming an oval opening in the back panel. The cut line 141 extends completely through the back panel 138. The cut line 141 thus defines a flap 142 in the front panel 132. The flap 142 can be bent inwardly and upwardly around the score line 140, thereby defining the respective handle cutouts 139. A selected flap 142 thus can be folded inwardly from the back panel 138 to open the desired handle cutout 139 as shown in FIG. 9, and that flap provides a cushioned hand grip for a person carrying the box 123 laden with a garment bag or the like. Optionally, the box 123 can have two such handle cutouts 139 at different elevations along the length of the back panel 138, so that persons of different heights or arm lengths can comfortably grasp and carry the box 123 without the relative inconvenience of a handle at the top end of the box. Furthermore, the handle cutout can be provided on the front panel 132 instead of the back panel as described herein.

A hanger cutout 145 is formed in the upper end panel 125 a short distance above the fold line 126. This hanger cutout 145 comprises a small flap formed by a semicircular cut line in continuous areas of the back panel 138 and the upper end panel 125, and having a circular opening 146 to receive the end of a garment hanger. The flap can be moved outwardly to expose an opening through which garment hangers can protrude from garments or garment bags contained within the box 123.

Turning next to FIGS. 10 and **10*a*, the box 150 shown therein is a modification of the embodiment previously described with respect to FIGS. 1–3*c*. The box 150 is shown assembled in FIGS. 10 and 10*a*, and includes a top panel 151 joined to a pair of side panels 152 and a bottom panel (not shown) by appropriate score: lines. A locking tab 156 similar to the locking tab 38 is formed in the top panel 151 by appropriate score lines and cut lines as previously described. An end panel 153 is connected to the bottom panel by a score line, in the manner of the end panel 24 in FIG. 3*a*. However, the end panel 153 has a tongue 154 protruding outwardly beyond the terminal edge 153*a* of the end panel but extending along only a central portion of the end panel, unlike the flap 29 extending the entire length of the end panel 24 in the embodiment shown in FIG. 3*a*. The tongue 154 is centered along the length of the terminal edge 153*a*, and a slot 155** is formed in the tongue.

The box 150 includes a pair of corner flaps 157 foldably connected to the side panels 152 by the score lines 158, in the manner of the corner flaps 26 in FIG. **3*a*. However, these corner flaps 157 in FIG. 10 are covered by a secondary end panel 159. That secondary end panel is formed as an extension of the top panel 15 1 and is foldably secured to the top panel by the score line 160 contiguous with the forward edge 161 of the top panel. The secondary end panel 159 is shown in FIG. 10 folded at a right angle relative to the top panel 51, although it should be understood that the top panel and the secondary end panel initially are coplanar in a box blank from which the box 151** is assembled.

A central portion 166 of the secondary end panel 159 is cut away to reveal an open space located between the opposed terminal ends of the two inwardly-folded corner flaps 157. The central portion 166 must be long enough to accommodate the width of the tongue 154 along the terminal edge 153*a* of the end panel 153, when the end panel is folded to close the box.

The box 150 is closed and locked in much the same manner as the box 32 previously described, with this difference: after the corner flaps 157 are folded inwardly to the position shown in FIG. 10, the secondary end panel 159 is folded downwardly to the position shown in that figure. The end of the box shown in FIG. 10 thus is closed both by the corner flaps 157 and by the secondary end panel 159. The end panel 153 next is folded on the score line 58 to close the end of the box, placing the end panel in the position shown in FIG. 10*a*. The tongue 154 of the end panel 153 at this time is inserted through the gap 162 formed by undercutting the inner edge of the secondary end panel 159 on each side of the central portion 166, and through the aligned gap formed between the inner edges of the corner flaps 157 and the forward edge 161 of the top panel 151.

Figure 3C:
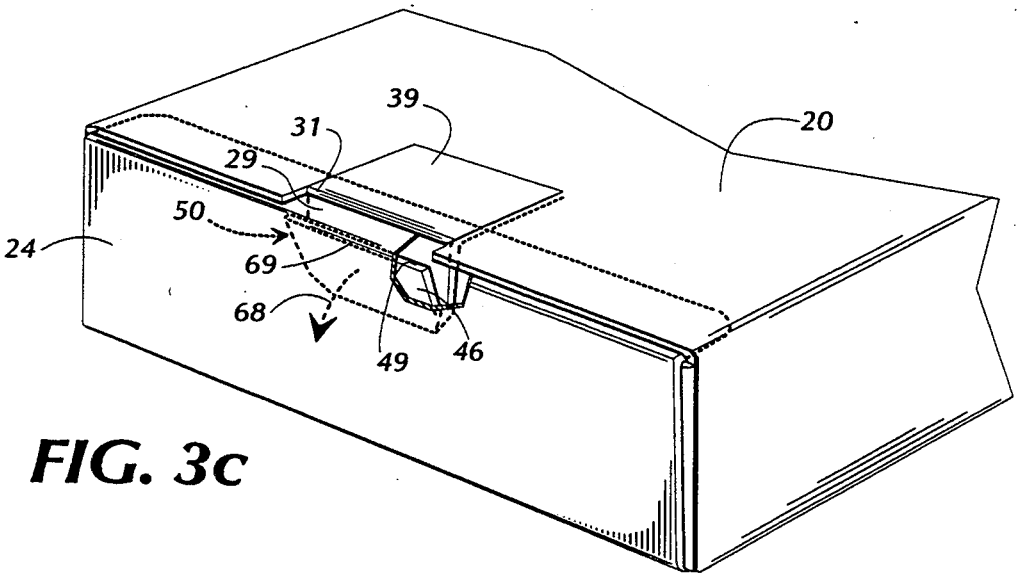

With the end of the box 150 thus closed by the corner flaps 157, the secondary end panel 159, and the end panel 153, the locking tab 156 next is folded in the manner of the locking tab 38 in FIGS. 3*a*–3*c*. This folding places the leading edge 171 of the locking panel 172 in alignment with and above the slot 155 in the tongue 154 of the end panel 153, a position shown in FIG. 10*a*. The locking panel next is pressed downwardly as indicated by the arrow 173, thereby moving the locking panel into and through the slot 155 in the manner discussed above. Once the locking panel 172 is fully moved into the slot 155, the terminal end 174 of the locking panel clears the edge of the slot and resiliently moves forward to engage the underside of the tongue 154. That engagement is permitted through the central portion 166 in the secondary end panel 159, and prevents withdrawing the locking panel 172 from the slot without mutilating the tongue 154 or another part of the box 150.

The addition of the secondary end panel 159 in the box 150 provides a substantial increase in the crush strength of that box. It will be appreciated that the depicted end of the box 150 (and also the other end if identical to the depicted end) has three separate layers of corrugated board extending between the top and bottom panels of the box. These separate layers are comprised of the folded corner flaps 157, the secondary end panel 159, and the end panel 153. In particular, the secondary end panel 159 is retained between the corner flaps 157 and the end panel 153, maintaining that secondary end panel perpendicular to the top and bottom panels of the box. Because the upper side (as viewed in FIGS. 10 and 10*a*) of the secondary end panel 159 is integral with the top panel 151 and the terminal edge 168 of the secondary end panel is held in contact with the bottom panel of the box, the secondary end panel remains perpendicular to the top and bottom panels of the box so that substantially the entire compression strength of that secondary end panel is available to withstand crushing loads that may be applied across the width of the box end. This increased resistance to crushing of the box is particularly important in boxes intended for use in parcel handling and delivery applications, where boxes containing a relatively light load may nonetheless be impacted by other boxes containing loads of significantly greater mass. Those skilled in the boxmaking art will realize that the selection of particular corrugated boards, and the orientation of the corrugation relative to the longitudinal dimensions of the box panels, also affect the strength of the box.

It will now be understood that the foregoing relates only to preferred embodiments of the present invention, and that numerous changes and modifications therein may be made without departing from the spirit and scope of the invention as defined in the following claims.

We claim:

1. A box that is lockable when closed, the box comprising:

a plurality of body panels interconnected to form a box;

an end panel connected to a first said body panel to selectively close an end of the box, and having a flap extending into the box to occupy a location adjacent to a second said body panel when the end panel closes the end of the box;

a slot located in the end panel flap;

a locking tab connected to the second body panel adjacent the location occupied by the flap;

said locking tab having a fold line defining a locking panel for insertion in the slot;

the locking panel having a central portion and a fold line defining a terminal portion selectably foldable to lie alongside the central portion with the fold line thereby forming a leading edge of the folded locking panel; and the locking panel with the terminal portion so folded being aligned for insertion by the leading edge through the slot into the box, whereat the terminal portion partially unfolds to abut the end panel, thereby locking the end panel to the second body panel to form a closed box.

2. A box as recited in claim 1, wherein the locking tab also comprises at least one lateral end portion connected to the central portion by a score line, the lateral end portion being foldable onto the central portion of the locking tab so that the folded lateral end portion is insertable through the slot with the locking tab to become at least partially unfolded inside the box, thereby preventing withdrawal of the locking tab from the slot.

3. The box as in claim 1, further comprising:

a secondary end panel extending outwardly from the second body panel and foldable to close the end of the box in substantially parallel relation to said end panel.

4. The box as in claim 3, further comprising:

an opening in the secondary panel through which the end panel flap is inserted when the end panel closes the end, so that the slot in the end panel flap is in position to receive the leading edge of the folded locking panel.

5. A box which is tamper-evident, the box comprising:

a plurality of body panels interconnected to form a box;

an end panel connected to one of the body panels to form an end surface of the box, and having a flap extending from an edge opposite to the connection to the body panel;

a slot located in the end panel flap;

a locking tab connected to and extending from a body panel opposite to the body panel to which the end panel is connected;

said locking tab comprising a shank portion terminating in a locking panel having a central portion and a front panel extending from a forward edge of the central portion; and a fold line between said central portion and said front panel forming a leading edge with at least a partially tapered profile when said front panel is folded upon said central portion, said locking tab when so folded being inserted through said slot whereupon said front panel elastically returns to a position inside the box to abut a surface of the end panel and the flap connected thereto, whereby the end panel is locked to said body panel to form a closed box which cannot thereafter be opened without severing the locking tab from the body panel or otherwise providing visible evidence of tampering.

6. The box as in claim 5, wherein the front panel is shorter than the central portion and has a terminal edge that abuts the end panel when the terminal edge clears the slot as the folded locking tab is moved therethrough.

7. The box as in claim 4, wherein;

the end panel is a first end panel forming a first end surface of the box, and further comprising:

a second end panel connected to one of the body panels to form a second end surface of the box, and having a flap extending from an edge opposite to said connection to the body panel;

a second slot located in the flap of the second end panel;

a second locking tab connected to and extending from a body panel opposite to the body panel to which the second end panel is connected;

said second locking tab comprising a shank portion having a width substantially similar to the length of said second slot, said shank portion terminating in a second locking panel having a central portion and a front panel extending from a forward edge of the central panel; and a fold line between said central portion and said front panel forming a leading edge with at least a partially tapered profile when the front panel is folded upon the central portion, said second locking tab when so folded being inserted through said second slot whereupon said front panel elastically returns to a position inside the box to abut a score line formed by the second end panel and the flap connected thereto, whereby the second end panel is locked to said body panel to form a closed box which cannot thereafter be opened without severing the second locking tab from the body panel or otherwise providing visible evidence of tampering.

8. The box as in claim 5, wherein the shank portion of the locking tab has a width substantially the same as the width of the slot.

9. The box as in claim 5, wherein the front panel comprises a leading edge that abuts the end panel when the front panel elastically returns after the folded locking tab is inserted through the slot.

10. The box as in claim 5, wherein:

the front panel has a leading edge;

a corner is formed by the box end panel and the flap connected thereto; and the leading edge of the front panel abuts the corner when the front panel returns to said position inside the box, thereby preventing withdrawal of the locking panel through the slot.

11. The box as in claim 5, wherein the central portion and the front panel contain indicia positioned so that the indicia move into mutual juxtaposition when the front panel is folded upon the central portion, the indicia thereby indicating a predetermined folding of the locking tab.

12. The box as in claim 5, wherein said folding of the front panel upon the central portion is a first folded position wherein the front panel folds in a first direction on the fold line between the central panel and the front panel to overlie an outer side of the central portion, so that the front panel can move to abut the box end panel when inserted through the slot; and the fold line allows folding the front panel in a second direction the opposite direction so as to overlie an inner surface of the central portion and presenting the partially tapered profile to enter said slot whereupon the front panel elastically returns to an unfolded position not abutting the end panel inside the box, so that in the second position the end panel engages the body panel to form a closed box but is not locked thereto, whereby the locking tab can be withdrawn from the body panel without severing the locking tab.

13. A one-piece blank for producing a box that is tamper-evident, the blank comprising:

two pairs of alternately disposed rectangular body and side panels connected on mutually parallel fold lines;

a pair of end panels, each said end panel connected to a body panel on mutually parallel second fold lines orthogonal to the first-mentioned mutually parallel fold lines;

at least one such end panel having a flap extending from an edge opposite to the connection to the body panel and foldable relative to the one end panel along a fold line parallel to the second fold lines;

a slot located in the flap; and a locking tab bendably connected, by a third fold line parallel to the second mutually parallel fold lines, to a body panel to which the one end panel is not connected;

the locking tab comprising a shank portion terminating in a locking panel having a central portion, and a front panel extending from a forward edge of the central portion and connected thereto by a tab fold line parallel to the third fold line; and the locking tab being located relative to the flap extending from the one end panel so that with the front panel folded upon the central portion to form a leading edge of the locking tab along the tab fold line and the folded locking tab inserted through the slot of a box produced from the blank, the front panel returns to a position inside the box such that a portion of the front panel abuts a surface of the flap and the end panel connected thereto, so that the one end panel of the box is locked to the body panel to which the one end panel is not connected and cannot be withdrawn without severing the locking tab or otherwise producing visible evidence of tampering.

14. A box which is tamper-evident, the box comprising:

a plurality of body panels interconnected to form a box;

an end panel connected to one of the body panels to form an end surface of the box, and having a flap extending from the edge opposite to an edge connected to the body panel;

a slot located in the end panel flap;

a locking tab integrally connected to and extending from a particular body panel opposite to the body panel to which the end panel is connected.

said locking tab comprising a shank portion terminating in a locking panel having a plurality of foldable panels, a leading edge, and a trailing edge, the trailing edge having a length greater than the length of the slot when the locking panel is in the unfolded state; and the leading edge having at least a partially tapered profile when the locking panel is in the folded state so that the leading edge has a length less than the length of the slot, the locking panel when so folded being inserted through the slot whereupon the locking panel returns automatically to a position inside the box such that the trailing edge of the locking tab is greater than the length of the slot to provide an abutment surface with a region of the end panel flap surrounding the slot, so that the end panel is locked to the particular body panel to form a closed box which cannot be opened without severing the locking tab from the particular body panel or otherwise providing visible evidence of tampering.

15. A box as in claim 14, wherein:

the locking panel is substantially triangular-shaped and has a central portion and lateral end portions on either side thereof to form a continuous leading edge, with fold lines connecting the lateral end portions to the central portion, so that when the lateral end portions are folded onto the central portion of the locking tab, the leading edge of the locking tab becomes arrow-shaped to facilitate inserting the locking tab through the slot.

16. A box as recited in claim 14, wherein the locking panel comprises a central portion and at least three polygonally-shaped lateral end portions connected to the central portion by score lines, the lateral end portions being folded sequentially onto the central portion of the locking tab to provide a continuous leading edge to facilitate insertion of the locking tab through the slot.

17. A box as recited in claim 14, wherein said locking panel comprises a central portion and at least three polygonally-shaped lateral end portions integrally connected to the central portion by score lines, said lateral end portions being folded sequentially onto said central portion of said locking tab to provide a continuous leading edge to facilitate insertion of said locking tab through said slot, with at least one of the lateral end portions engaging another of the lateral end portions when the locking tab is inserted into the box to bias the one lateral end portion away from the central end portion to provide a more secure locking engagement with the body panel of the box.

18. A box as recited in claim 14, wherein the locking tabs are recessed in and pivotably connected to the body panel to facilitate insertion of said locking tab through said slot.

19. A box as recited in claim 14, wherein the slot is nonlinear to render more difficult the reorientation of the locking tab necessary to separate the locking tab from the slot without providing visible evidence of tampering.

20. A box as recited in claim 19, wherein the nonlinear slot comprises a central portion terminating at each distal end with a tapered portion, the length of said central portion exceeding the aggregate lengths of said tapered portions.

21. A box that is lockable when closed, the box comprising:

a plurality of body panels interconnected to form a box;

an end panel connected to a first said body panel to selectively close an end of the box, and having a flap extending into the box to occupy a location adjacent to a second said body panel when the end panel closes the end of the box;

a slot located in the end panel flap;

a locking tab connected to the second body panel adjacent the location occupied by the flap;

said locking tab having a fold line defining a locking panel for insertion in the slot;

the locking panel having a central portion and a fold line defining a terminal portion selectably foldable to lie alongside the central portion;

the locking panel with the terminal portion so folded being aligned for insertion through the slot into the box whereat the terminal portion partially unfolds to abut the end panel, thereby locking the end panel to the second body panel to form a closed box;

the second body panel having an edge opposite the connection of the end panel to the first body panel;

the fold line connecting the locking tab to the second body panel being spaced inwardly from the edge so that part of the locking tab is formed within the second body panel; and the fold line defining the locking panel being located between the edge of the second body panel and the fold line defining the locking tab, so that the locking tab with folded terminal portion is aligned for entry into the slot spaced inwardly from the edge of the second body panel.

22. A box that is lockable when closed, the box comprising:

a plurality of body panels interconnected to form a box;

an end panel connected to a first said body panel to selectively close an end of the box, and having a flap extending into the box to occupy a location adjacent to a second said body panel when the end panel closes the end of the box;

a slot located in the end panel flap;

a locking tab connected to the second body panel adjacent the location occupied by the flap;

said locking tab having a fold line defining a locking panel for insertion in the slot;

the locking panel having a central portion and a fold line defining a terminal portion selectably foldable to lie alongside the central portion;

the locking panel with the terminal portion so folded being aligned for insertion through the slot into the box whereat the terminal portion partially unfolds to abut the end panel, thereby locking the end panel to the second body panel to form a closed box; the second body panel having an edge opposite the connection of the end panel to the first body panel;

the second body panel having an edge opposite the connection of the end panel to the first body panel;

the slot in the end panel flap being disposed behind the second body panel inwardly from the edge thereof, when the end panel closes the box;

the fold line connecting the locking tab to the second body panel being spaced inwardly from the edge so that part of the locking tab is formed within the second body panel; and the fold line defining the locking panel being located between the edge of the second body panel and the fold line defining the locking tab for entry into the slot so that the locking panel with folded terminal portion is aligned for entry into the slot spaced inwardly from the edge of the second body panel.

* * * * *